US006290003B1

(12) United States Patent
Russell

(10) Patent No.: US 6,290,003 B1
(45) Date of Patent: Sep. 18, 2001

(54) CONTROLLABLE STABILIZER

(75) Inventor: Michael Russell, Cheltenham (GB)

(73) Assignee: Smart Stabilizer Systems Limited, Cheltenham (GB)

( * ) Notice: Subject to any disclaimer, the term of this patent is extended or adjusted under 35 U.S.C. 154(b) by 0 days.

(21) Appl. No.: 09/494,110

(22) Filed: Jan. 28, 2000

(30) Foreign Application Priority Data

Jan. 30, 1999 (GB) ..... 9902023

(51) Int. Cl.[7] ..... E21B 7/06
(52) U.S. Cl. ..... 175/73; 175/325.1
(58) Field of Search ..... 175/45, 61, 73, 175/74, 76, 325.1, 325.2, 325.5

(56) References Cited

U.S. PATENT DOCUMENTS

| | | | | |
|---|---|---|---|---|
| 4,394,881 | | 7/1983 | Shirley . | |
| 5,000,272 | | 3/1991 | Wiebe et al. . | |
| 5,220,963 | * | 6/1993 | Patton | 175/24 |
| 5,311,953 | * | 5/1994 | Walker | 175/61 |
| 5,318,138 | * | 6/1994 | Dewey et al. | 175/74 |
| 5,603,386 | | 2/1997 | Webster . | |
| 6,092,610 | * | 7/2000 | Kosmala et al. | 175/61 |

FOREIGN PATENT DOCUMENTS

| | | |
|---|---|---|
| 0 209 318 A2 | 1/1987 | (EP) . |
| 0 497 422 A1 | 8/1992 | (EP) . |
| 0 685 623 A3 | 12/1995 | (EP) . |

* cited by examiner

*Primary Examiner*—Frank S. Tsay
(74) *Attorney, Agent, or Firm*—Ratner & Prestia

(57) ABSTRACT

A controllable stabilizer (16; 116) in which an outer sub-assembly (22) is rotatably mounted around an inner sub-assembly (20). An annulus (58; 158) is movably mounted around the outer sub-assembly (22) to be radially displaced in a predetermined direction by selective hydraulic energisation of individual pistons (52; 152) in a piston/cylinder array (48; 148). The piston(s) selected to be energised are determined by a directionally-sensitive control system (18). The outer sub-assembly (22) carries a hydraulic pump (38; 138) operated by a driving mechanism (28; 128) carried on the inner sub-assembly (20); this pump (38; 138) provides hydraulic power for the pistons (52; 152). An alternator (34+56; 134+156) is similarly mounted and driven to provide on-board electrical power for the control system (18). In use, the annulus (58; 158) functions as a well-bore-contacting stabilizer casing, and the controllable stabilizer (16; 116) provides a directionally controlled deviation to a drillstring (12; 112) so enabling directional drilling, and full control of changes in direction without interruption of drilling.

19 Claims, 8 Drawing Sheets

Section A-A

CONTROLLABLE STABILIZER

BACKGROUND OF THE INVENTION

This invention relates to a controllable stabilizer, and relates more particularly but not exclusively to a controllable direction deviator for use in steering the direction in which a well is drilled, e.g. to produce a deviated oil well.

Modern drilling techniques for the creation of wells between a surface drilling station and oil-bearing geological strata horizontally remote from the surface drilling station require close control of the drilled well to a pre-planned trajectory. Known directional drilling techniques typically involve the use of a downhole drilling motor and a bent sub, with the drill pipe being non-rotating and the rotational position of the bent sub being used to determine the direction of deviation (i.e the direction and angular extent to which the currently projected drilling direction deviates from a straight-ahead projection of the most recently drilled section of the well; directional drilling may thus be considered as downhole steering of the drill).

Prior to the use of downhole motors with bent subs for directional drilling, whipstocks were used to deviate rotating drilling assemblies. The disadvantages of whipstocks were that they required orientation by drillstring movements initiated from the surface station, and that the whipstocks had to be reset (re-orientated) after the drilling of relatively short distances.

It is an object of the invention to provide a substitute for known directional drilling techniques, in the form of a controllable stabilizer for producing a radial load in a rotatable drillstring or drill shaft such as to control the deviation of a well being drilled. It is a further object of the invention to provide a directionally-controlled eccentric which is also applicable to producing directionally controlled eccentricity In circumstances which may not involve drilling.

BRIEF SUMMARY OF THE INVENTION

According to a first aspect of the present invention there is provided a controllable stabilizer in the form of a directionally-controlled eccentric comprising a first sub-assembly and a second sub-assembly, the first sub-assembly being adapted to be rotated in use by rotation of a rotatable shaft, the second sub-assembly being rotatably mounted with respect to the first sub-assembly, the second sub-assembly comprising eccentric thrust means controllably radially extensible in a predetermined direction to exert an eccentric sidethrust, the second sub-assembly being rotatably mounted with respect to the rotatable shaft such that eccentric sidethrust exerted by the eccentric thrust means is reacted in use by the rotatable shaft to tend to deviate the shaft in a direction opposite to the direction of the eccentric sidethrust, the directionally-controlled eccentric further comprising directionally-sensitive control means for sensing direction and for controllably radially extending the eccentric thrust means in a direction which tends to deviate the rotatable shaft in a requisite direction.

Preferably, mutually cooperating ports of the first and second sub-assemblies constitute hydraulic pump means functioning upon relative rotation of the first and second sub-assemblies to generate hydraulic power for use by the controllable stabilizer. Further mutually cooperating parts of the first and second sub-assemblies preferably constitute alternator means or other dynamo-electric generating means for generating electric power for use by the controllable stabilizer.

Preferably also, the eccentric thrust means are radially extensible by hydraulic linear motor means.

Preferably also, said control means controls hydraulic power from the hydraulic pump means to the hydraulic means in a manner which controllably radially extends the eccentric thrust means in a direction which tends to deviate the rotatable shaft in a requisite direction.

Said second sub-assembly is preferably rotatably mounted on said first sub-assembly.

Said hydraulic pump means is preferably a positive-displacement hydraulic pump. The hydraulic power output of the hydraulic pump means is preferably comprised in said second subassembly. Said control means is preferably comprised in said first sub-assembly. Said control means may comprise a controllable drain valve hydraulically coupled to said hydraulic means, said drain valve being controllably openable to drain hydraulic power from said hydraulic means and thereby cause or allow said eccentric thrust means to retract radially, said drain valve being controllably closable to prevent hydraulic power being drained from said hydraulic means and thereby tend to cause said eccentric thrust means to be radially extended.

Said eccentric thrust means and said hydraulic means preferably comprise a circumferentially distributed plurality of radially displaceable pistons each slidably mounted in and slidably sealed to a respective cylinder formed in the periphery of said second sub-assembly. The hydraulic power output of said hydraulic pump means is preferably commutated to successive individual ones of said cylinders in synchronism with rotation of said second sub-assembly with respect to said first sub-assembly, and said controllable drain valve is controlled to be closed only when said hydraulic power output is commutated to a given cylinder whose piston is intended to be extended. The radially outer ends of the radially displaceable pistons comprised in said eccentric thrust means and hydraulic means are preferably circumscribed by a unitary ring or tyre which is preferably substantially rigid and serves in use to transfer the eccentric sidethrust to the wall of drilled hole in which the stabilizer is operating.

The first and second sub-assemblies are preferably mutually coupled by a coupling mechanism which constrains relative longitudinal movement between the two sub-assemblies while permitting a range of relative radial movements between the two sub-assemblies sufficient to encompass requisite deviation of the shaft, the coupling mechanism preferably also limiting relative rotational movement between the two sub-assemblies. The coupling mechanism may comprise a plurality of part-annular segments secured to or integral with the second sub-assembly and further comprise a circumferentially extending slot in the first sub-assembly, the segments radially depending into the slot to permit relative radial movement of the second sub-assembly with respect to the first sub-assembly while preventing substantial relative longitudinal movement between the two sub-assemblies. The slot is preferably circumferentially interrupted by radially extending key means secured to or integral with the first sub-assembly, the key means being disposed in inter-segment gaps to prevent substantial rotational movement of the second sub-assembly with respect to the first sub-assembly.

According to a second aspect of the present invention there is provided a directional drilling assembly for controllable deviation of a well or other hole being drilled by said drilling assembly, said drilling assembly comprising a rotatable drillstring and a controllable stabilizer according to the first aspect of the present invention, said first sub-assembly being mounted around and secured to said drillstring, said second sub-assembly being rotatably mounted around said drillstring and/or said first sub-assembly.

The directionally-sensitive control means of the controllable stabilizer is preferably responsive to resolved vectors of the geomagnetic field.

BRIEF DESCRIPTION OF THE SEVERAL VIEWS OF THE DRAWINGS

Embodiments of the invention will now be described by way of example with reference to the accompanying drawings wherein.

DETAILED DESCRIPTION OF THE PREFERRED EMBODIMENTS OF THE INVENTION

Figure 1:
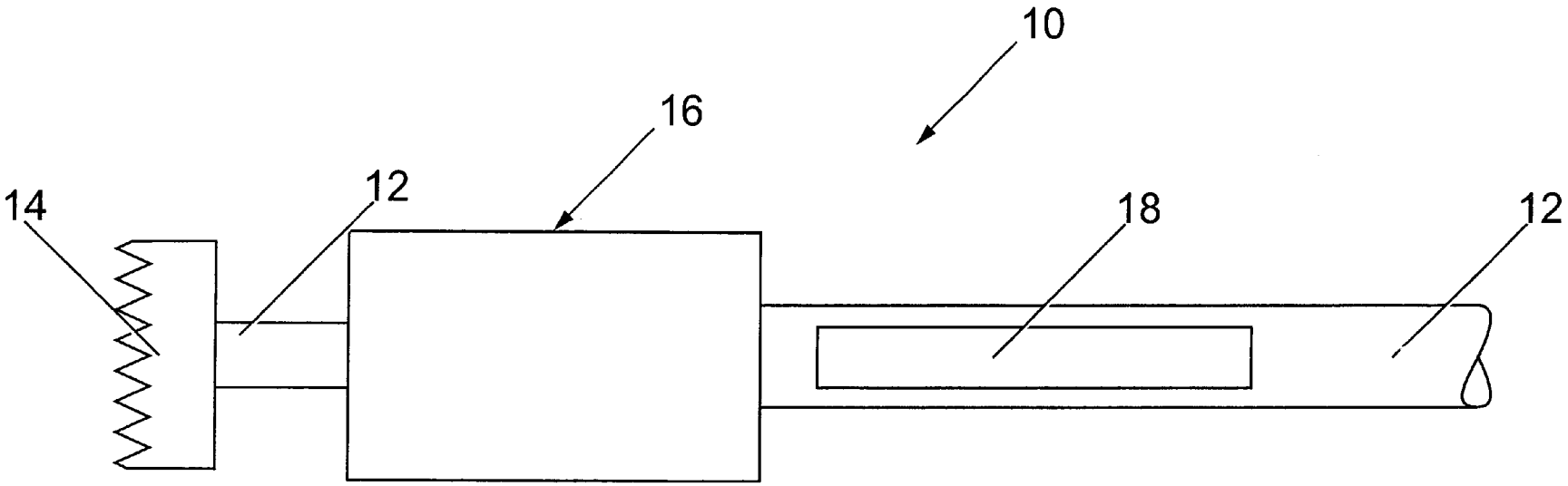
FIG. 1 is a schematic diagram of the overall arrangement of a directional drilling assembly.

Referring first to FIG. 1, this Is an overall schematic of a directional drilling assembly 10 for controllable deviation of a well (not shown) or other hole being drilled by the assembly 10. The directional drilling assembly 10 comprises a rotatable drillstring 12 having a drill bit 14 at the downhole end of the drillstring 12 (i.e. the left end as viewed in FIG. 1). At a suitable distance uphole from the downhole end of the drillstring 12, a directionally-controlled eccentric stabilizer 16 is mounted around the drillstring 12. (The operating principles of the eccentric 16 will subsequently be described with reference to FIG. 2). Adjacent the eccentric 16, the drillstring 12 contains a directionally-sensitive control system 18 comprising direction sensors and a suitably programmed computer (nor shown separately). The control system 18 is responsive to resolved vectors of the geomagnetic and gravitational field, i.e. the assembly 10 can navigate in three dimensions by means of on-board sensing of the planetary magnetic and gravitational fields resolved into orthogonal vectors in a known manner, with appropriate computation being performed on the basis of the vector values.

Figure 2:
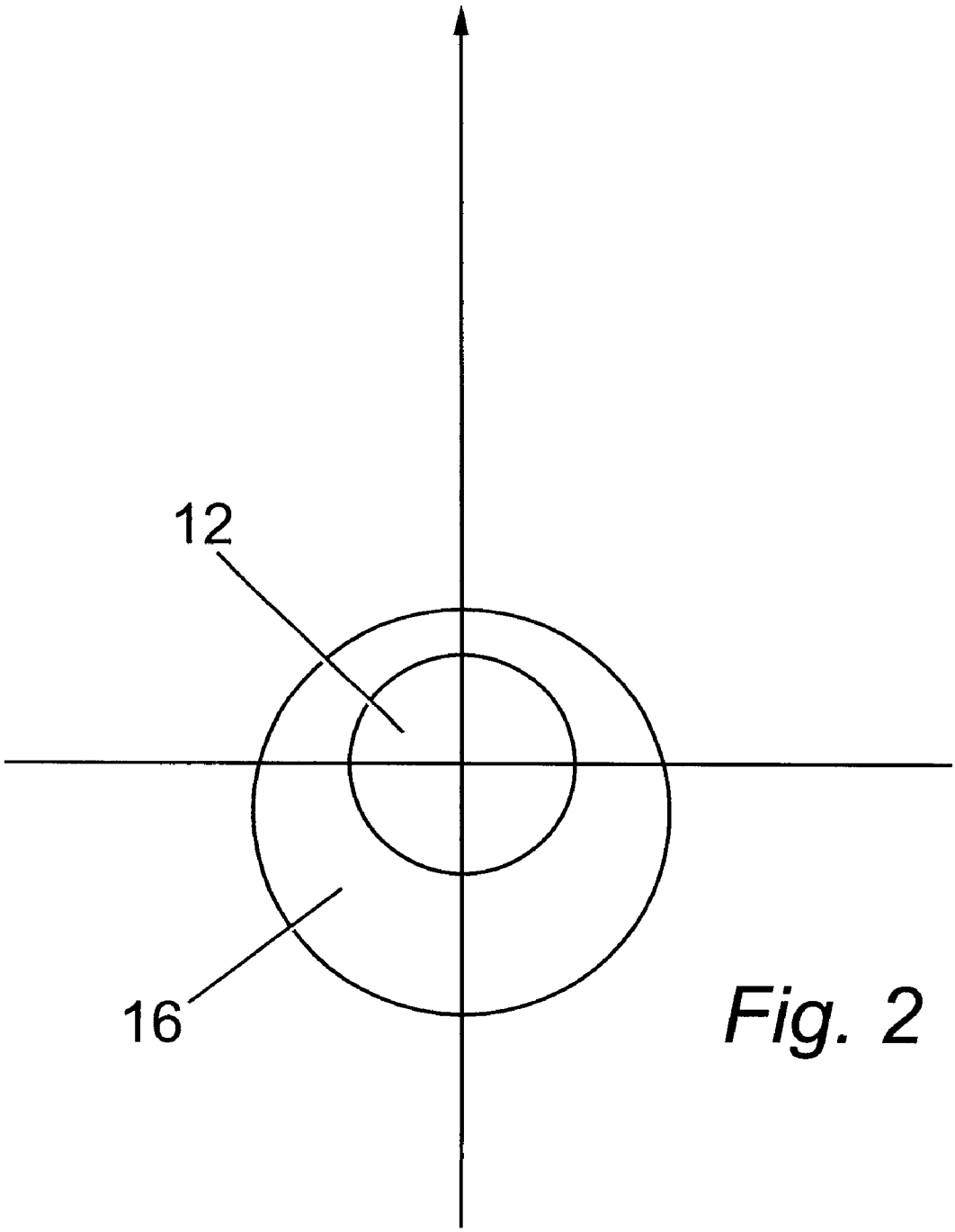
FIG. 2 is a diagram demonstrating the operating principle of the invention.

Referring now to FIG. 2, the function of the eccentric 16 is to radially offset the periphery of the eccentric 16 from concentricity with the drillstring 12, this radial offset being controllably directed in the direction opposite to the intended direction of deviation of the drilling assembly 10 (i.e. the direction towards which further drilling is intended to proceed with a deviation from straight-ahead drilling). As schematically depicted in FIG. 2 (which is a cross-section of the FIG. 1 arrangement in a plane orthogonally transverse to the longitudinal axis of the assembly 10), the drillstring 12 is horizontal, and the eccentric 16 is displaced vertically downwards from the a diametrically central rotational axis of the drillstring 12. Since the periphery of the eccentric 16 will normally be in contact with the wall of the drilled hole shortly uphole of the drill bit 14 (whose diameter will be equal to or marginally greater than the peripheral diameter of the eccentric 16), the downward offset of the eccentric 16 with respect to the rotational axis of the drillstring 12 lifts the drillstring 12 with respect to the centreline of the drilled hole. Consequently, further drilling will be deviated in an upwards direction.

Details of the internal mechanisms of the eccentric 16 will now be described with reference to FIGS. 3 and 4.

Figure 3:
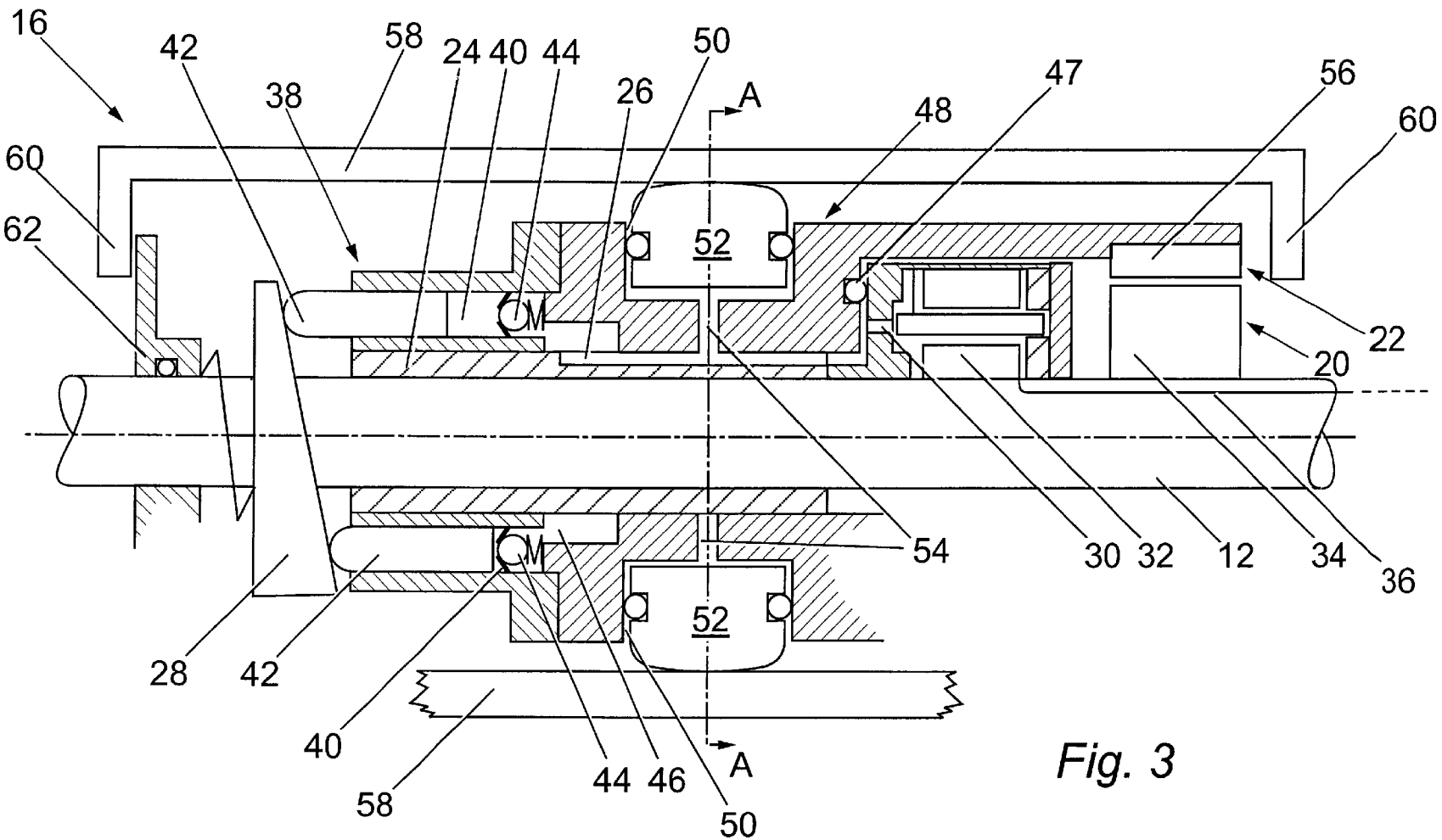
FIG. 3 is a diametral cross-section of a first form of directionally-controllable eccentric stabilizer forming part of the directional drilling assembly of FIG. 1.
Figure 4:
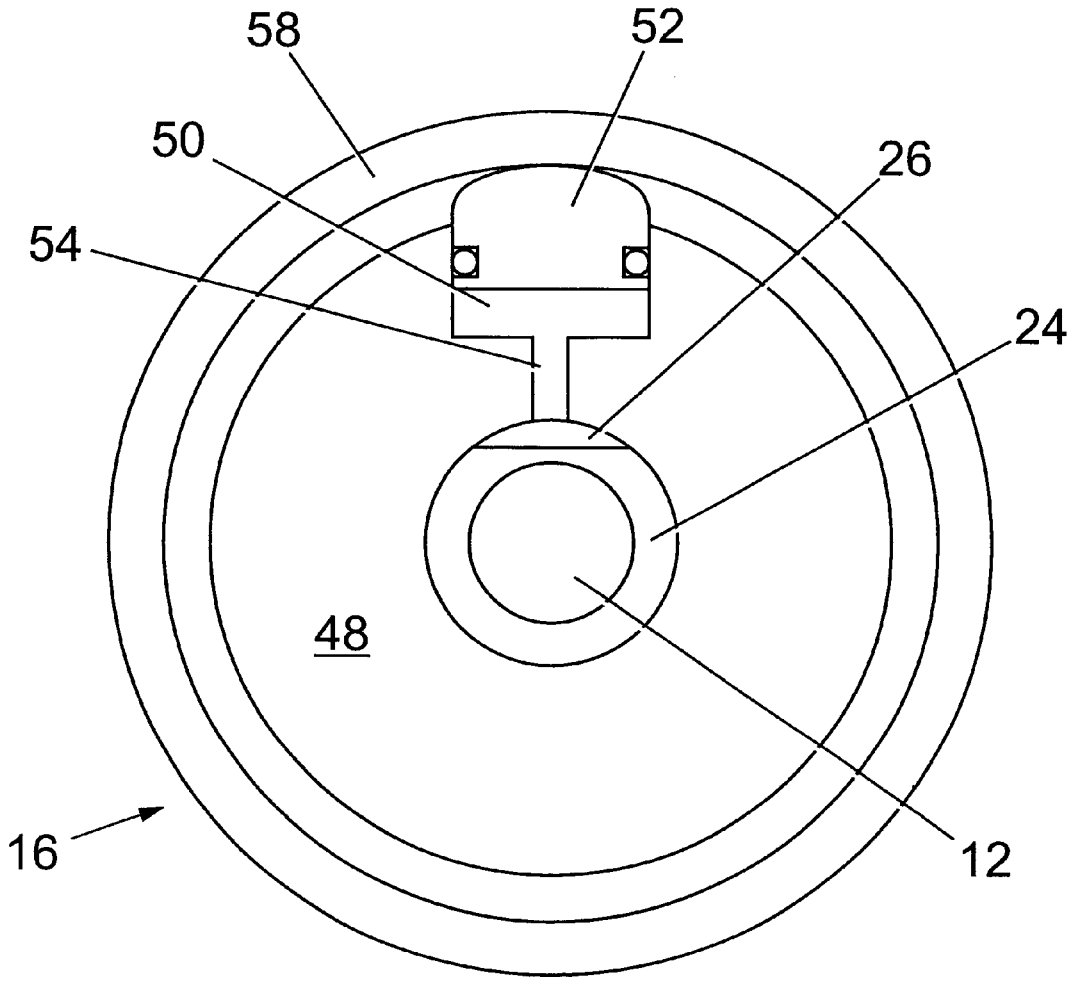
FIG. 4 is a transverse cross-section (in simplified form) of the stabilizer of FIG. 3.

FIG. 3 is a diametral cross-section of the directionally-controlled eccentric 16, taken in a plane including the longitudinal axis of the eccentric 16 which is coincident with the rotational axis of the drillstring 12 around which the eccentric 16 is mounted. FIG. 3 is diagrammatic, and parts of the eccentric 16 are omitted for clarity.

The eccentric 16 comprises a first sub-assembly 20 and a second sub-assembly 22. The first sub-assembly 20 is mounted on and secured to the drillstring 12. The second sub-assembly 22 is rotatably mounted around the first sub-assembly 20 such that the first (inner) sub-assembly 20 is rotated by the rotating drillstring 12 while the second (outer) sub-assembly 22 remains stationary.

The first sub-assembly 20 comprises a hydraulic commutating valve 24 in the form of a sleeve secured to the periphery of the drillstring 12. Part of the outer circumference of the valve sleeve 24 is relieved to form a longitudinal channel 26 whose function will be subsequently explained. The first sub-assembly 20 further comprises a swash plate 28 rigidly secured to the drillstring 12 and presenting an inclined surface towards the adjacent end of the second sub-assembly 22 for reciprocating the pistons of a hydraulic pump as will be detailed below. The first sub-assembly 20 further comprises a hydraulic drain valve 30 having an actuating solenoid 32 and a spring (not shown) by which the valve 30 is normally held open,.for a purpose to be explained subsequently. The first sub-assembly 20 additionally comprises an alternator armature 34 for local generation of electric power. The armature 34 and the solenoid 32 are connected by cables 36 to the control system 18 (FIG. 1; omitted from FIG. 3).

The second sub-assembly 22 comprises an axial-piston pump 38 having a circumferentially distributed array of axially aligned cylinders 40 in each of which is a respective piston 42 axially urged (leftwards as viewed in FIG. 3) by suitable means (e.g. a Urinal not shown) against the inclined face of the swash plate 28. One-way inlet valves (not shown) admit hydraulic oil under suction into each cylinder 40 as the respective piston 42 withdraws from it, and one-way outlet valves 44 discharge oil under pressure from each cylinder 40 as the respective piston 42 is driven into that cylinder by the inclined face of the swash plate 28 which reciprocates relative to individual ones of the cylinders 40 as the first and second sub-assemblies undergo mutual rotation. The outputs of the cylinders 40 collectively feed into an annular manifold 46 which in turn feeds the channel 26 in the commutating valve 24. The annular manifold 46 is formed in the second sub-assembly 22 and serves an a hydraulic slipring to transfer hydraulic power to the channel 26 in the valve 24 forming part of the first sub-assembly 20.

The end of the channel remote from the pump 38 and the manifold 46 is hydraulically coupled to the drain valve 30. A large-diameter rotary seal 47 (schematically depicted as an O-ring coaxial with the centreline of the drillstring 12) provides the requisite sliding seal a between the relatively rotating first and second sub-assemblies 20 and 22. While the drain valve 30 is open, pressure cannot build up in the channel 26, despite the non-stop operation of the pump 38. When the drain valve 30 is closed, hydraulic pressure builds up in the channel 26 and is utilised in a manner described below. (The interior of the eccentric 16 is pealed and filled with hydraulic oil which serves as a reservoir for the pump 38 and other parts of the hydraulic circuit).

A major component of the second sub-assembly 22 is a body 48 providing six radially outwardly directed opened-ended cylinders 50 in each of which a respective piston 52 is slidingly sealed. The cylinders 50 and the pistons 52 are equi-angularly distributed around the body 48, only two of those pistons and cylinders being visible in the cross-section of FIG. 3 while all but one piston and cylinder are omitted from FIG. 4 for clarity. Each of the radial cylinders 50 is individually hydraulically coupled by a respective radial passage 54 to the inside diameter of the body 48, but none of the cylinders 50 is hydraulically directly coupled to any of the of the cylinders 50 and the significance of this mutual isolation (in hydraulic terms) of the cylinders 50 will be explained below with reference to FIG. 4.

An additional part of the second sub-assembly 22 is a magnetic field system 56 which functionally cooperates with the armature 34 to generate electric power when the sub-assemblies 20 and 22 undergo relative rotation in operation of the eccentric 16.

The eccentric 16 is circumscribed by a rigid steel annulus 58 is normally non-rotating and serves to contact the wall of the drilled hole (not shown) while serving as a protective enclosure for the interior of the eccentric 16 as a whole, and as a particular protection for the outer ends of the radial pistons 52. The annulus 58 thus acts as a form of rim or tyre for spokes constituted by the array of six radially extending pistons 52. The annulus 58 is axially restrained but allowed radial freedom within adequate limits by means of inturned end rims 60 which slidingly cooperate with flanges 62 secured to the drillstring 12 at each end of the eccentric 16 (only the flange 62 at the left end being shown in FIG. 3, the corresponding flange 62 at the right end of the eccentric 16 being omitted from FIG. 3). The incorporation of suitable fluid seals (not shown) between the cooperating faces of the annulus rims 60 and the flanges 62 allows the interior of the eccentric 16 (bounded by the annulus 58) to serve as the aforementioned reservoir of hydraulic oil.

The directional functionality of the centric 16 will now be explained with reference to FIG. 4 wherein only a single one of the six radial cylinders 50 and associated pistons 52 is illustrated, the others being omitted for clarity. When observing FIG. 4, it is to be remembered that the central components, namely the drillstring 12 and thy valve sleeve are rotating. In contrast, the body 48 carrying the radial cylinder 50 and radially extensible piston 52 is non-rotating, while the surrounding annulus 58 is also normally non-rotating although some rotational slippage will not affect the functioning of the eccentric 16. Because each of the passages 54 (only one being shown in FIG. 4) links only a respective one of the cylinders 50 to the interior of the body 48 where it is in close sliding contact with the periphery of the valve 24, the shape and dimensions of the channel 26 ensure that only a single one at a time of the cylinders 50 is hydraulically communicated through the channel 26 to the pump output manifold 46 and the hydraulic power output of the pump 38. The valve 24 and its channel 26 therefore constitute a hydraulic commutator, switching one radial cylinder 50 at time to the output of the pump 38.

As long as the drain valve 30 is allowed to remain open, none of the six cylinders 50 will pressurised. However, when the direction sensors in be the control system 18 determine that the channel 26 is rotationally aligned in an appropriate direction, the drain valve 30 is momentarily closed. This momentary closure of the valve 30 allows hydraulic pressure to build up, which pressure increase is transferred, via the passage 54 currently aligned with the channel 26, to the respective cylinder 50 and to the underside of the piston 52 in that cylinder. This momentary pressurisation causes that piston 52 to move radially outwards and thus produce an eccentric sidethrust on the annulus 58 which displaces the drillstring 12 in the manner illustrated in FIG. 2 and so deviates the drilling in a predetermined direction (The intended direction of deviation and/or the timing of the momentary closure of the drain valve 30 may be such that two (or more) adjacent cylinders 50 are pressurised and consequently two (or more) adjacent pistons 52 are radially extended, but this does not alter the principles of operation).

Once the channel 26 has rotated past the intended direction of deviation, the drain valve 30 in caused or allowed to reopen, thus preventing unwanted pressurisation of cylinders not aligned in the intended direction. The cylinder 50 (or two adjacent cylinders 50) which was (were) previously pressurized to radially extend the respective piston(s) 52 will have its (or their) pressurisation retained by the closing off of the radially inner end(s) of the respective passage(s) 54 by the periphery of the valve 24 where it is not relieved by the channel 26. When the channel 26 next again rotates under a previously pressurised cylinder 50, the drain valve 30 is again momentarily closed to maintain the pressurisation and radial extension, and consequent deviation of the drillstring 12. The momentary drain valve closures and cylinder pressurisations will be repeated until ouch time as deviation in the particular direction is no longer required, whereafter sustained opening of the drain valve will depressurise the previously pressurised cylinder and thus cause or allow the respective piston to retract radially so to cease providing eccentric sidethrust.

The annulus 58 may have its periphery formed similarly to the periphery of a known form of drillstring stabilizer (not shown) intended to be rotatably mounted on a rotary drillstring, with the conventional longitudinal slots serving to permit normal circulation of drilling mud.

If the direction sensors built-in to the control system is operate by sensing vector components of the terrestrial magnetic field, at least the adjacent components of the assembly 10 should be non-magnetic.

The arrangement shown the drawings can be adapted to providing eccentric sidethrust on a rotatable shaft in circumstances other than the drilling of a well.

Other modifications and variations in the above-described embodiments can be adopted without departing from the scope of the invention. For example, more than one set of radial cylinder/piston arrangements 50, 52 may be provided, axially spaced along the sub-assembly 22. Further, rotating seals may be provided between the first sub-assembly 20 and the second sub-assembly 22, with non-rotating seals being fitted between the second sub-assembly 22 and the annulus 58.

Figure 5:
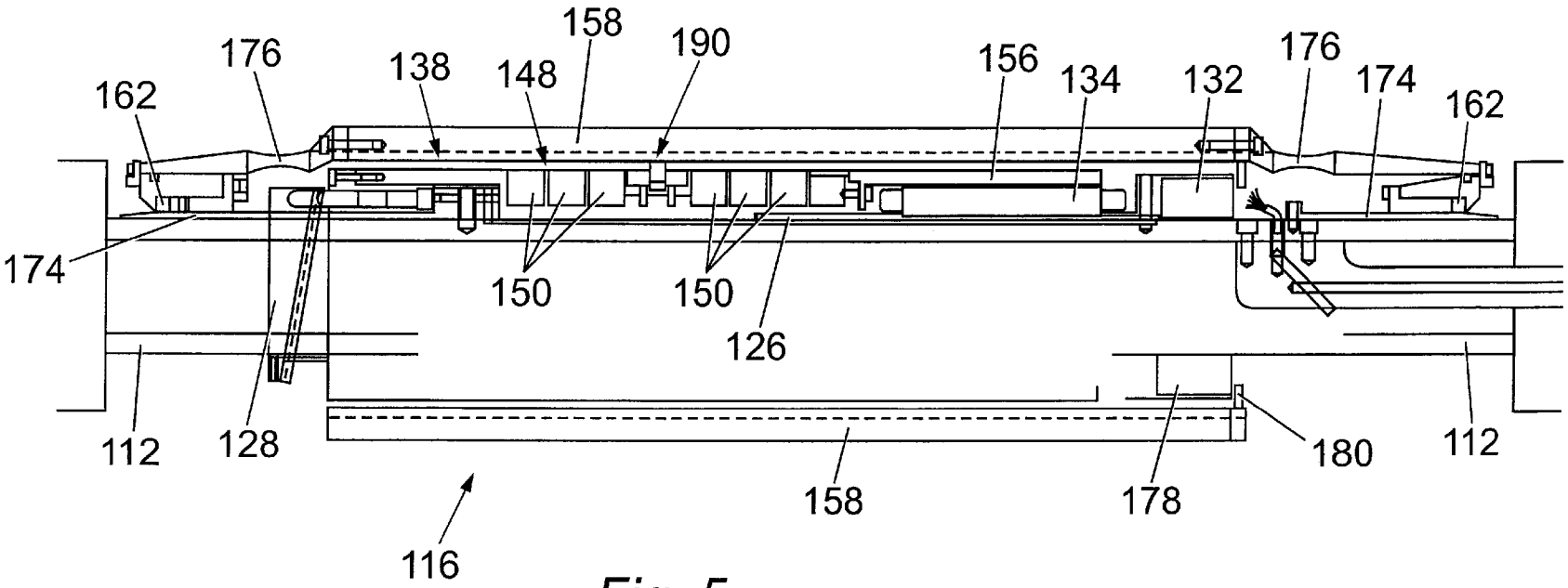
FIG. 5 is a diametral cross-section of a second form of directionally-controllable eccentric stabilizer.

Turning now to FIG. 5, this is a diametral cross-section of a second form of directionally-controllable eccentric stabilizer in accordance with the invention, the view in FIG. 5 corresponding to the FIG. 3 view of the first embodiment Since the FIG. 5 eccentric stabilizer is generally similar to the FIG. 3 eccentric stabilizer, those components and sub-assemblies of the FIG. 5 stabilizer that correspond to identical or analogous components and sub-assemblies in the FIG. 3 stabilizer are given the same reference numeral but preceded by a leading "1"; for a description of these components and sub-assemblies, reference should be made to the fore-going description of the FIG. 3 stabilizer.

The following description of the FIG. 5 stabilizer will concentrate principally on those parts which differ significantly from the FIG. 3 stabilizer.

Figure 6:
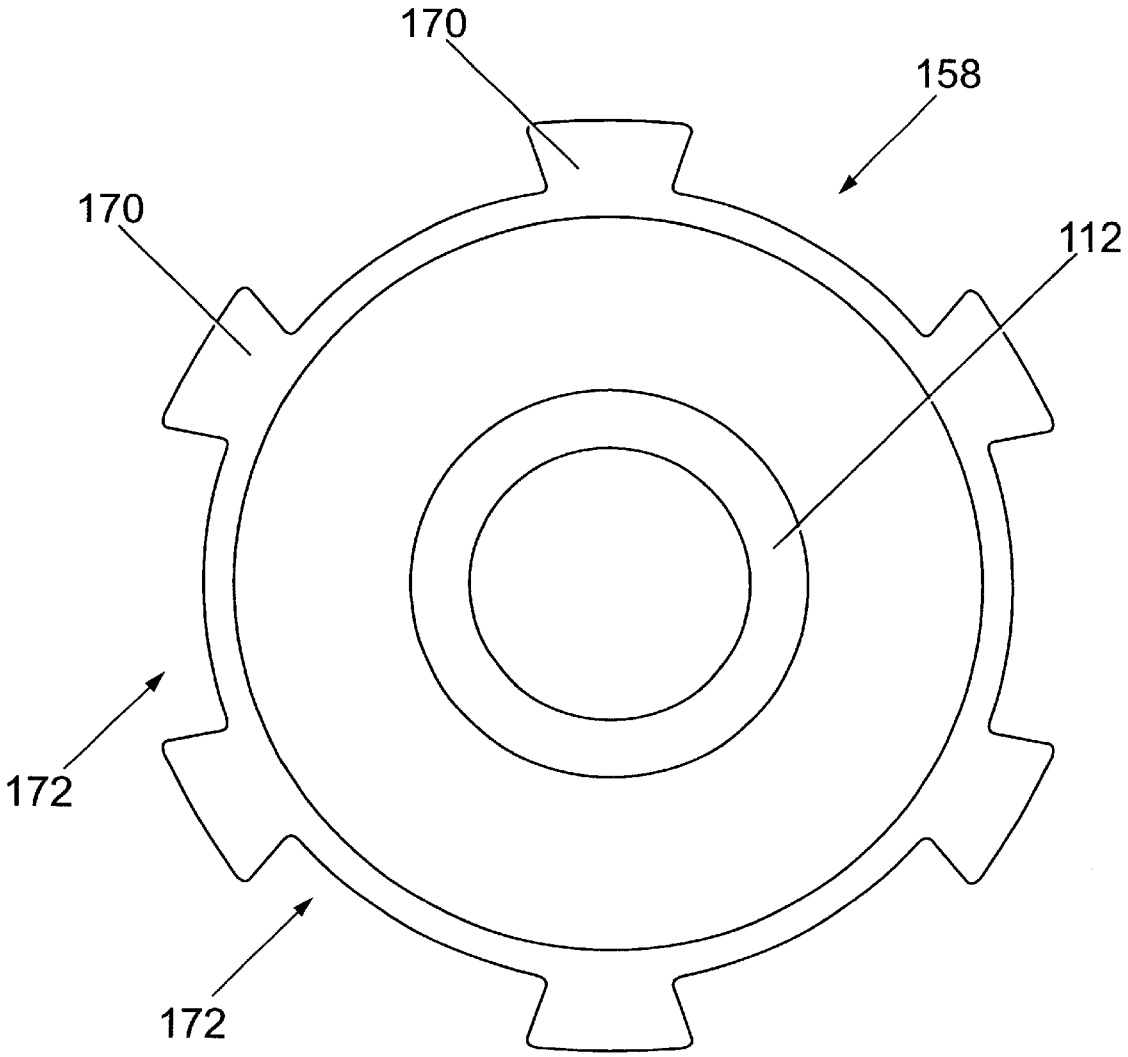
FIG. 6 is a transverse cross-section (in simplified form) of the stabilizer of FIG. 5.

In the FIG. 5 stabilizer 116, the drillstring or driveshaft 112 is hollow (see also FIG. 6), and the outer annulus 158 is provided with six longitudinally extending fins 170 which define intervening junk slots 172 for the passage of debris-laden drilling mud in an uphole direction. In place of the sliding seals provided by the rims 60 and flanges 62 of the FIG. 3 stabilizer 16, the FIG. 5 stabilizer 116 has conventional shaft seals 162 which bear directly on seal sleeves 174 mounted directly on the shaft 112 at is each end of the stabilizer 116. Since the seals 162 are concentric with the shaft 112 but the annulus 158 is variably eccentric with respect to the shaft 112, relative displacements between the seals 162 and the annulus 158 are accommodated by elastomeric linking rings 176.

The cylinder body 148 takes the form of two longitudinally spaced banks of cylinders 150 at 30° spacings in triple rows of twelve, to make a total of seventy-two cylinders.

The rotational position of the stabilizer 116 with respect to the shaft 112 is determined by a shaft-mounted coil transducer 178 cooperating with twenty-four equi-angularly spaced armatures 180 mounted inside one end of the annulus 158.

Figure 7:
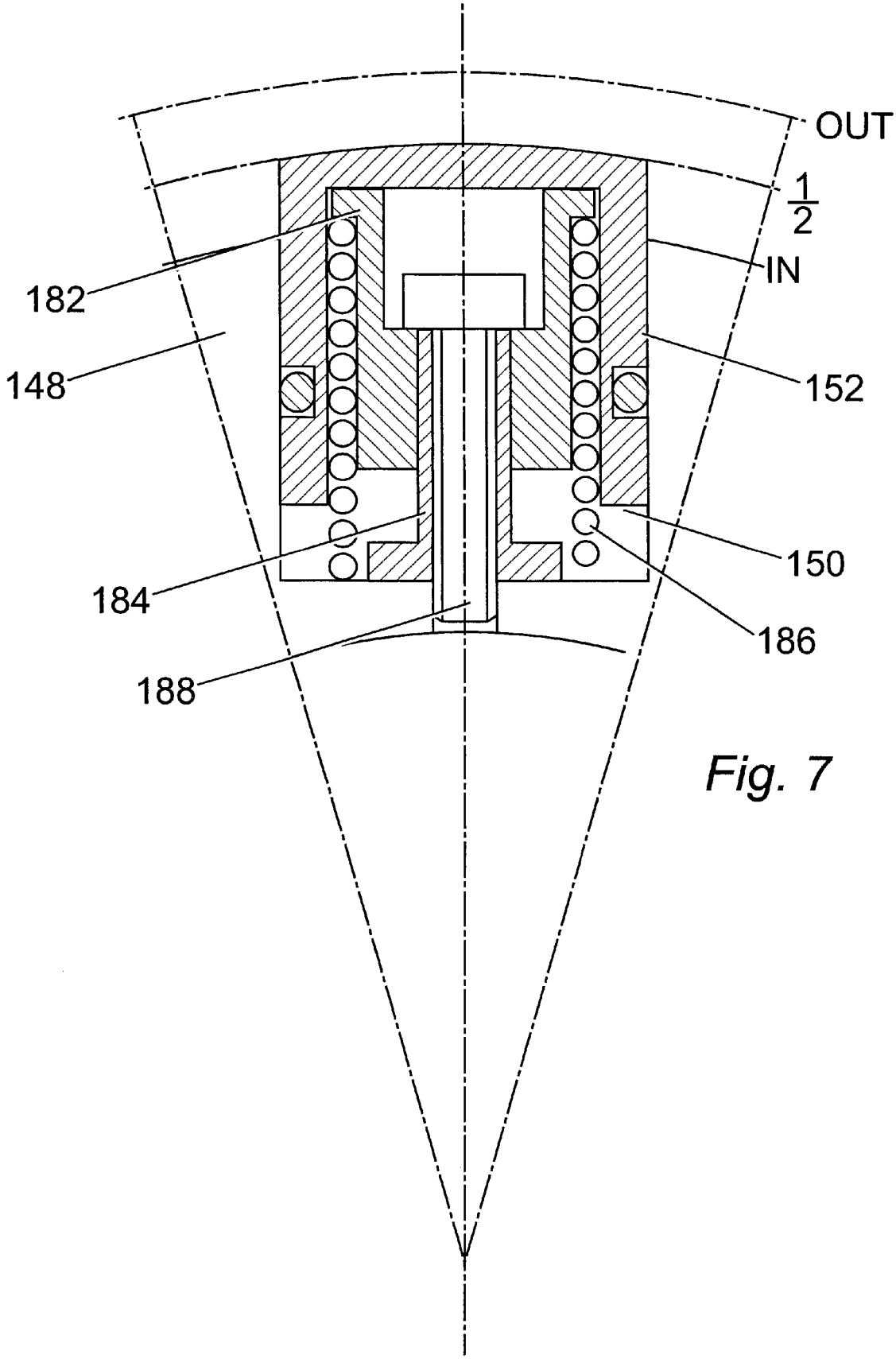
FIG. 7 is a simplified section of the FIG. 5 stabilizer corresponding to the view of FIG. 4.

As shown in FIG. 7, the pistons 152 (only one of which is shown in FIG. 7 for simplicity) are modified for spring-return to their radially half-extended positions as shown in FIG. 7. The modification takes the form of a coaxially mounted inner piston 182 which is radially slidable on a fixed bush 184 under the influence of a coiled compression spring 186, but whose radially outward movement is limited by a central cap-screw 188 screw-threaded into the base of the cylinder 150 such that the inner piston 182 can move radially outwards no more than half-way. Thus the inner piston 182 bears against the underside of the head of the annulus-displacing photon 152 so long as the latter is no more than radially half-extended. The piston 152 moves between radially half-extended and radially fully extended positions solely under the influence of hydraulic pressure selectively admitted into the cylinder 150 through the commutating valve 126. When all pistons 152 are fully relieved of hydraulic pressure at the end of eccentric operation of the stabilizer 116, the springs 186 in each piston assembly bias the respective piston 152 to its half-extended position and so tend to radially centralise the annulus 158.

Figure 9:
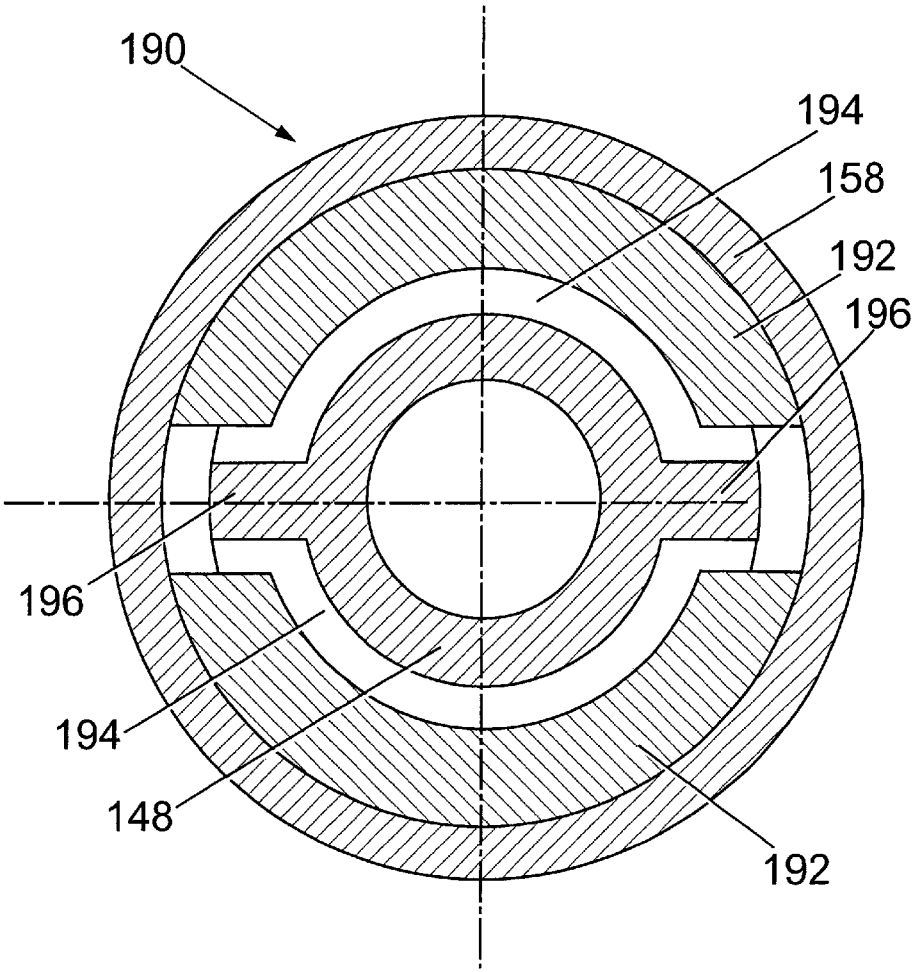
FIG. 9 is a cross-section of the coupling mechanism taken on the line IX—IX in FIG. 8.
Figure 8:
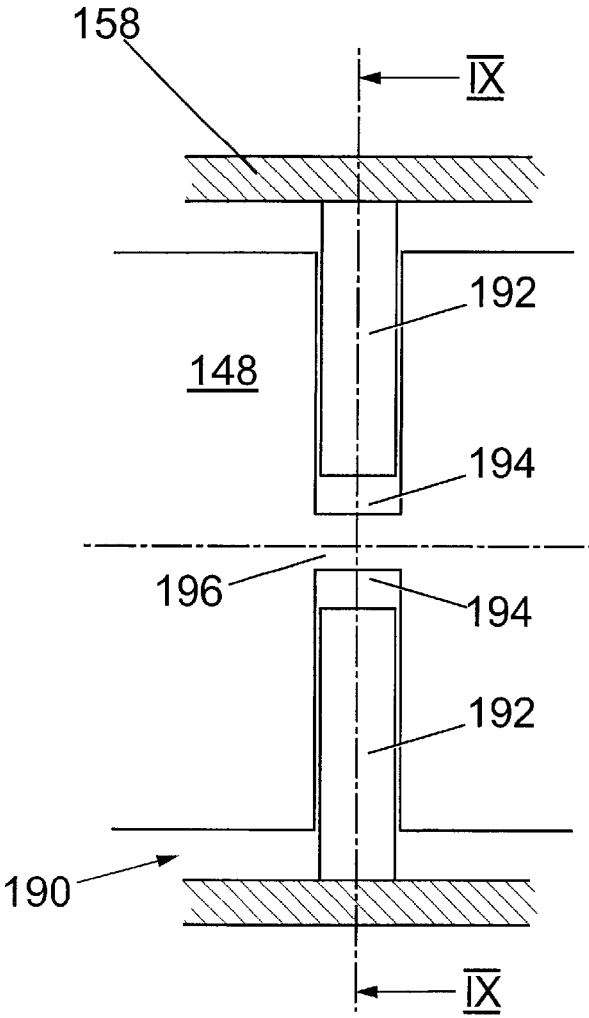
FIG. 8 is a part-view, to an enlarged scale, of a motion-restraining coupling mechanism of the FIG. 5 stabilizer.

Whereas in the FIG. 3 stabilizer 16, axial restraint and radial freedom of the annulus 58 with respect to the remainder of its stabilizer 16 was provided by the interaction of the end rims 60 with the flanges 62, in the FIG. 5 stabilizer 116 equivalent motional restraints are provided by a motion-restraining coupling mechanism 190 which will now be detailed with reference to FIGS. 8 & 9. For the sake of clarity, FIGS. 8 & 9 are simplified schematic drawings rather than mechanically exact diagrams.

The coupling mechanism 190 comprises two part-annular segments 192 secured to the interior of the annulus 158 in a common diametral plane, The segments 192 radially depend into a circumferential groove 194 formed in the body 148. The groove 194 is radially deeper than the innermost extent of the segments 192 by at least the maximum radial displacement or eccentricity of the annulus 158 with respect to the body 148. The groove 194 is longitudinally wider than the longitudinal thickness of the segments 192 by a margin sufficient to prevent binding of the segments 192 in the groove 194 during relative movement of the annulus 158 with respect to the body 148.

Circumferential continuity of the groove 194 is interrupted by a diametrically opposed pair of radially extending keys 196 which fit between adjacent ends of the segments 192 with anti-binding clearance. The keys 196 prevent more than minimal relative rotation of the annulus 158 with respect to the body 148, and thus prevent the annulus 158 spinning freely with respect to the body 148.

The coupling mechanism 190 allows the annulus 158 to be radially displaced with respect to the body 148 during operation of the stabilizer 116 while simultaneously preventing any significant longitudinal or rotational movement of the annulus 158 with respect to the body 148, thereby ensuring correct limits on relative movements between the first and second sub-assemblies of the stabilizer 116 during its operation.

While certain preferred embodiments of the invention have been described above together with some possible modifications and variations thereof, the invention is not restricted thereto, and other modifications and variations can be adopted without departing from the scope of the invention as defined in the appended claims,

What is claimed is:

1. A controllable stabilizer in the form of a directionally-controlled eccentric comprising a first sub-assembly and a second-sub-assembly, the first sub-assembly being adapted to be rotated in use by rotation of a rotatable shaft, the second sub-assembly being rotatably mounted with respect to the first sub-assembly, the second sub-assembly comprising eccentric thrust means controllably radially extensible in a predetermined direction to exert an eccentric sidethrust, the second sub-assembly being rotatably mounted with respect to the rotatable shaft such that eccentric sidethrust exerted by the eccentric thrust means is reacted in use by the rotatable shaft to tend to deviate the shaft in a direction opposite to the direction of the eccentric sidethrust, the directionally-controlled eccentric further comprising directionally-sensitive control means for sensing direction and for controllably radially extending the eccentric thrust means in a direction which tends to deviate the rotatable shaft in a requisite direction.

2. A controllable stabilizer as claimed in claim 1, including hydraulic pump means, said hydraulic pump means comprising a first part forming part of said first sub-assembly and a second part forming part of said second sub-assembly, said first and second parts cooperating upon relative rotation of the first and second sub-assemblies to generate hydraulic power for use by the controllable stabilizer.

3. A controllable stabilizer as claimed in claim 2, wherein the eccentric thrust means are radially extensible by hydraulic linear motor means.

4. A controllable stabilizer as claimed in claim 3, wherein said control means controls hydraulic power from the hydraulic pump means to the hydraulic linear motor means in a manner which controllably radially extends the eccentric thrust means in a direction which tends to deviate the rotatable shaft in a requisite direction.

5. A controllable stabilizer as claimed in claim 3, wherein the control means comprises a controllable drain valve hydraulically coupled to the hydraulic linear motor means, said drain valve being controllably openable to drain hydraulic power from the hydraulic linear motor means and thereby cause or allow the eccentric thrust means to retract radially, said drain valve being controllable closable to prevent hydraulic power being drained from the hydraulic linear motor means and thereby tend to cause the eccentric thrust means to be radially extended.

6. A controllable stabilizer as claimed in claim 5, wherein the eccentric thrust means and the hydraulic linear motor means comprise a circumferentially distributed plurality of radially displaceable pistons each slidably mounted in and slidably sealed to a respective cylinder formed in the periphery of the second sub-assembly.

7. A controllable stabilizer as claimed in claim 6, wherein the hydraulic power output of the hydraulic pump means is commutated to successive individual ones of the cylinders in synchronism with rotation of the second sub-assembly with respect to the first sub-assembly, and the controllable drain valve is controlled to be closed only when said hydraulic power output is commutated to a given cylinder whose piston is intended to be extended.

8. A controllable stabilizer as claimed in claim 6, wherein the radially outer ends of the radially displaceable pistons comprised in the eccentric thrust means and in the hydraulic linear motor means are circumscribed by a unitary ring or type which is substantially rigid and serves in use to transfer the eccentric sidethrust to the wall of a drilled hole in which the stabilizer is operating.

9. A controllable stabilizer as claimed in claim 2, wherein the hydraulic pump means is a positive-displacement hydraulic pump.

10. A controllable stabilizer as claimed in claim 2, wherein the hydraulic power output of the hydraulic pump means is comprised in the second sub-assembly.

11. A controllable stabilizer as claimed in claim 1, including dynamo-electric generating means for generating electric power for use by the controllable stabilizer, said dynamo-electric generating means comprising a rotor forming part of said first sub-assembly and a stator forming part of said second sub-assembly.

12. A controllable stabilizer as claimed in claim 1, wherein the second sub-assembly is rotatably counted on the first sub-assembly.

13. A controllable stabilizer as claimed in claim 12, wherein the first and second sub-assemblies are mutually coupled by a coupling mechanism which constrains relative longitudinal movement between the two sub-assemblies while permitting a range of relative radial movements between the two sub-assemblies sufficient to encompass requisite deviation of the shaft.

14. A controllable stabilizer as claimed in claim 13, wherein the coupling mechanism limits relative rotational movement between the two sub-assemblies.

15. A controllable stabilizer as claimed in claim 13, wherein the coupling mechanism comprises a plurality of part-annular segments secured to or integral with the second sub-assembly and further comprises a circumferentially extending slot in the first sub-assembly, the segments radially depending into the slot to permit relative radial movement of the second sub-assembly with respect to the first sub-assembly while preventing substantial relative logitudinal movement between the two sub-assemblies.

16. A controllable stabilizer as claimed in claim 15, wherein the slot is circumferentially interrupted by radially extending key means secured to or integral with the first sub-assembly, the key means being disposed in inter-segment gaps to prevent substantial rotational movement of the second sub-assembly with respect to the first sub-assembly.

17. A controllable stabilizer as claimed in claim 1, wherein the control means is comprised in the first sub-assembly.

18. A directional drilling assembly for controllable deviation of a well or other hole being drilled by said drilling assembly, said drilling assembly comprising a rotatable drillstring and a controllable stabilizer in the form of a directionally-controlled eccentric comprising a first sub-assembly and second sub-assembly, the first sub-assembly being adapted to be rotated in use by rotation of a rotatable shaft, the second sub-assembly being rotatably mounted with respect to the first sub-assembly, the second sub-assembly comprising eccentric thrust means controllably radially extensible in a predetermined direction to exert an eccentric sidethurst, the second sub-assembly being rotatably mounted with respect to the rotatable shaft such that eccentric sidethurst exerted by the eccentric thrust means is reacted in use by the rotatable shart to tend to deviate the shaft in a direction opposite to the direction of the eccentric sidethrust, the directionally-controlled eccentric further comprising directionally-sensitive control means for sensing direction and for controllably radially extending the eccentric thrust means in a direction which tends to deviate the rotatable shaft in a requisite direction, wherein the first sub-assembly is mounted around and secured to said drillstring, the second sub-assembly being rotatably mounted around said drillstring and/or around the first sub-assembly.

19. A directional drilling assembly as claimed in claim 18, wherein the directionally-sensitive control means of the controllable stabilizer is responsive to resolved vectors of the geomagnetic ore gravitational field.

* * * * *